US006564485B1

(12) United States Patent
Hess

(10) Patent No.: US 6,564,485 B1
(45) Date of Patent: May 20, 2003

(54) FIRE SIMULATING ASSEMBLY

(75) Inventor: Kristoffer Hess, Cambridge (CA)

(73) Assignee: Dimplex North America Limited, Cambridge (CA)

( * ) Notice: Subject to any disclaimer, the term of this patent is extended or adjusted under 35 U.S.C. 154(b) by 0 days.

(21) Appl. No.: 09/649,043

(22) Filed: Aug. 29, 2000

(51) Int. Cl.[7] ..... G09F 19/00
(52) U.S. Cl. ..... 40/428; 392/348
(58) Field of Search ..... 40/428; 362/92, 362/96, 253, 806; 392/348; 472/65

(56) References Cited

U.S. PATENT DOCUMENTS

| | | | |
|---|---|---|---|
| 1,199,882 | A | 10/1916 | Frey |
| 1,719,622 | A | 7/1929 | Price |
| 1,992,540 | A | 2/1935 | Newton |
| 2,009,167 | A | 7/1935 | Delano |
| 2,285,535 | A | 6/1942 | Schlett |
| 3,395,476 | A | 8/1968 | Moss et al. |
| 3,499,239 | A | 3/1970 | Mungo |
| 3,603,013 | A | 9/1971 | Reed et al. |
| 3,699,697 | A | 10/1972 | Painton |
| 3,978,598 | A | 9/1976 | Rose et al. |
| 4,890,600 | A | 1/1990 | Meyers |
| 4,965,707 | A | 10/1990 | Butterfield |
| 5,642,580 | A | 7/1997 | Hess et al. |

FOREIGN PATENT DOCUMENTS

| | | | |
|---|---|---|---|
| EP | 0611921 | B1 | 9/1999 |
| GB | 414280 | | 8/1934 |
| GB | 968568 | | 9/1964 |
| GB | 978364 | | 12/1964 |
| GB | 1088577 | | 10/1967 |
| GB | 1186655 | | 4/1970 |
| GB | 1443772 | | 7/1976 |
| GB | 1457540 | | 12/1976 |
| GB | 2149090 | A | 6/1985 |
| GB | 2151772 | A | 7/1985 |
| GB | 2180927 | B | 11/1988 |
| GB | 2240171 | A | 7/1991 |
| GB | 2256040 | A | 11/1992 |
| GB | 2264555 | A | 9/1993 |
| GB | 2290865 | A | 1/1996 |
| GB | 2298073 | | 8/1996 |
| WO | PCT/CA97/00299 | | 11/1997 |
| WO | PCT/CA99/00190 | | 9/1999 |

*Primary Examiner*—Brian K. Green

(57) ABSTRACT

A fire simulating assembly is provided having a light source, a vertical screen having a diffusing surface and a partially reflective surface, and a rear mirror having a reflective flame pattern. The assembly also includes a rotatable flicker element for reflecting light transmitted by the light source onto the rear mirror so that the light irregularly varies in intensity, so that a simulated flame effect results from the reflection of the light from the rear mirror onto the diffusing screen. The assembly also has a simulated fuel bed, positioned so that the simulated flames appear to arise from the simulated fuel bed. The flicker element also alternately obscures, partially obscures, and permits light transmitted by the light source to pass to a front reflector so that the light irregularly varies in intensity. The front reflector reflects the light onto the front of the simulated fuel bed so that the simulated fuel bed appears to include glowing embers.

9 Claims, 9 Drawing Sheets

FIRE SIMULATING ASSEMBLY

FIELD OF THE INVENTION

The present invention relates to fire simulating assemblies and, in particular, a fire simulating assembly for use in electric fireplaces and stove facsimile units and the like.

BACKGROUND OF THE INVENTION

Electric fireplaces are popular because they provide the visual qualities of real fireplaces without the costs and complications associated with venting of combustion gases. Similarly, although free-standing stove facsimile units having glass fronts in which, for example, natural gas is burned are popular alternatives to real fireplaces, combustion gases must also be vented from such stoves, and electric stove facsimile units are therefore also popular. Assemblies for producing realistic simulated flames are disclosed in U.S. Pat. No. 5,642,580 (Hess et al.) and U.S. Pat. No. 6,047,489 (Hess et al.). The flame simulating assemblies disclosed in these patents use systems including a billowing flame effect element having a plurality of slits with flame shapes cut into it or, alternatively, a solid flame element with flame shapes cut into it, and a diffusion screen onto which images resembling flames are projected. In the disclosed flame simulating assemblies, light from a light source is reflected toward at least one flicker element disposed at the rear of a simulated firebox to produce an image resembling moving flames which is reflected onto a screen. The light source also provides light directed generally upwardly from underneath a partly translucent simulated fuel bed to cause the simulated fuel bed to resemble burning logs and embers. However, the light directed upwardly onto the simulated fuel bed does not vary in intensity.

There is a need for an assembly for producing a simulated flame that more realistically resembles the flame from a burning log and that more realistically simulates burning logs and burning embers.

SUMMARY OF THE INVENTION

In one of its aspects, the invention provides a fire simulating assembly comprising a light source, a vertical screen having a diffusing surface and a partially reflecting surface, and a rear mirror having a flame pattern thereon and spaced rearwardly from the vertical screen such that a flame image is reflectable from the rear mirror onto the diffusing surface. The fire simulating assembly also includes a rotatably mounted flicker element for reflecting light transmitted by the light source onto the rear mirror reflective surface such that the light apparently irregularly varies in intensity, and a rotator for rotating the flicker element. The fire simulating assembly also includes a simulated fuel bed assembly positioned in front of the vertical screen, such that the flame image resembles flames arising from the simulated fuel bed assembly, and a front reflector positioned in front of the simulated fuel bed assembly and having a front reflective surface. The flicker element also alternately reflects, obscures, partially obscures, and permits light transmitted by the light source to pass to the front reflective surface such that the light apparently irregularly varies in intensity. The front reflector is positioned such that the light transmitted from the light source and passing to the front reflective surface is reflected upwardly onto the simulated fuel bed assembly, so that the simulated fuel bed assembly resembles a fuel bed on fire.

In another aspect, in the fire simulating assembly, the apparent irregular variation in intensity of light reflected by the front reflective surface onto the simulated fuel bed assembly is relatively slower than the apparent irregular variation in intensity of light reflected onto the rear mirror reflective surface.

In another aspect, the invention provides a fire simulating assembly for use in a simulated firebox, the simulated firebox having a front and a rear, and having walls including a transparent front panel. The fire simulating assembly comprises a light source, a rear mirror disposed on an interior side of the rear wall and facing the interior of the firebox, the rear mirror having a reflective pattern resembling flames and a front reflector disposed at the front and on the bottom wall of the firebox. The fire simulating assembly also comprises a rotatably mounted flicker element having at least one reflective surface and a longitudinal axis, the flicker element being disposed between the light source and the front reflector so that a first light portion of light transmitted by the light source is irregularly and alternately reflected, obscured, partially obscured, and permitted to pass to the front reflector by the flicker element and the first light portion appears to vary irregularly in intensity. The fire simulating assembly also includes a rotator for rotating the flicker element about the longitudinal axis. The light source and the flicker element are disposed each relative to the other so that a second light portion of light transmitted by the light source is reflected upon the rear mirror, and the second light portion appears to vary irregularly in intensity. In addition, the fire simulating assembly comprises a screen having a partially reflecting surface and a diffusing surface, wherein the second light portion is reflected from the rear mirror onto the partially diffusing surface to provide an image of moving flames on the screen, and a simulated fuel bed assembly positioned forward of the screen and adjacent to the screen so that the simulated fuel bed assembly is reflected in the partially reflecting surface to cause the image of moving flames to appear to arise from the simulated fuel bed assembly. The simulated fuel bed assembly is positioned rearward of the front reflector and adjacent to the front reflector, so that the first light portion can be reflected upwardly from the front reflector onto the simulated fuel bed assembly to provide an image of burning embers and fuel.

In yet another aspect, the invention provides a fire simulating assembly for use in a simulated firebox, the simulated firebox having a back wall, a bottom wall, and a top wall, at least two sidewalls connecting the back wall, the top wall, and the side walls to form a box-like enclosure, and the simulated firebox having a transparent front panel. The fire simulating assembly includes a light source, a rear mirror disposed on the back wall and facing to the front of the simulated firebox, and having an image of flames in a reflective finish thereon, and a front reflector disposed in the vicinity of the front of the simulated firebox. The fire simulating assembly also comprises a rotatably mounted flicker element having at least one reflective element, the flicker element having a longitudinal axis, and a rotator for rotating the flicker element about the longitudinal axis. The flicker element is positioned intermediate of the light source and the front reflector to cause a first light portion of the light transmitted from the light source to appear to be varying in intensity when the first light portion is reflected by the front reflector. The flicker element is also positioned so as to cause a second portion of the light from the light source to be reflected onto the rear mirror, and the second light portion also appears to be varying in intensity. In addition, the fire simulating assembly includes a simulated fuel bed disposed adjacent to the front reflector, so that the first light portion is reflected onto the simulated fuel bed, to cause the simulated fuel bed to appear to glow irregularly and pulsatingly, with the glowing effect varying in intensity. The fire simulating assembly also includes a screen having a partially reflecting surface and a diffusing surface, the screen being disposed rearwardly of the simulated fuel bed intermediate the simulated fuel bed assembly and the rear mirror, and the partially reflecting surface being disposed adjacent to the simulated fuel bed so that the second light portion produces an image on the screen that resembles moving flames which appear to arise from the simulated fuel bed.

BRIEF DESCRIPTION OF THE DRAWINGS

The invention will be better understood with reference to the drawings, and following description, in which.

DETAILED DESCRIPTION OF THE PREFERRED EMBODIMENT(S)

Figure 1:
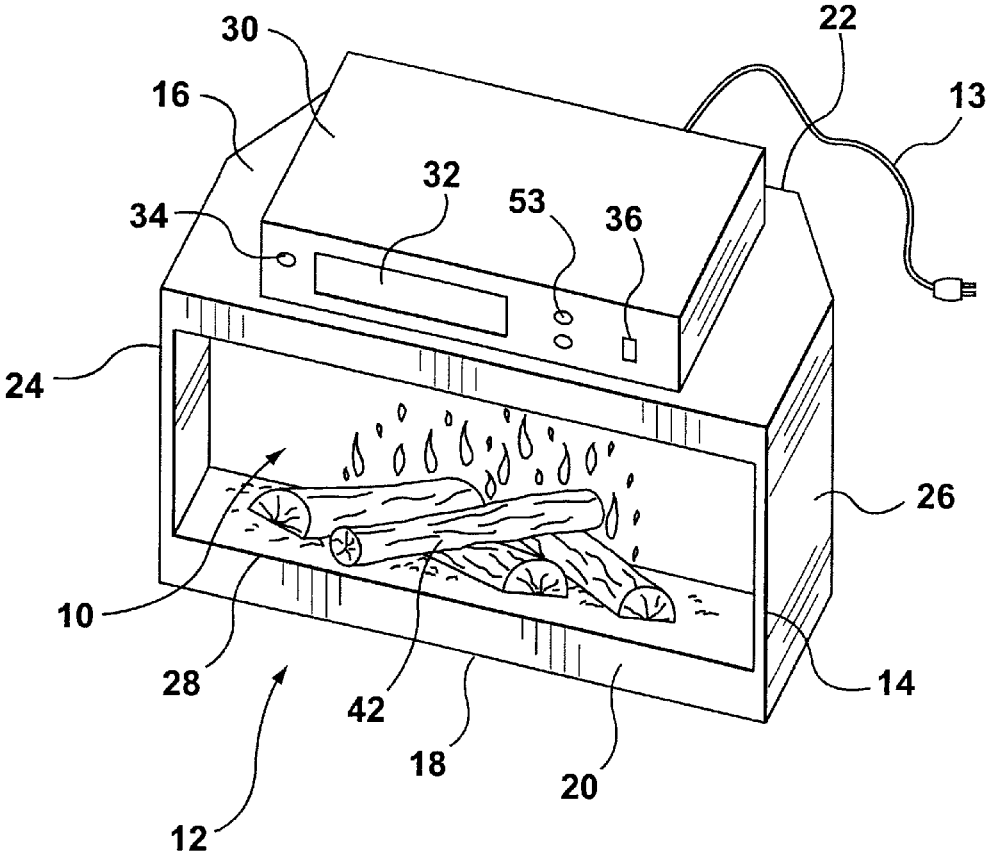
FIG. 1 is a perspective view of a simulated firebox in an electric fireplace incorporating a preferred embodiment of the invention, with a control unit thereon.
Figure 3:
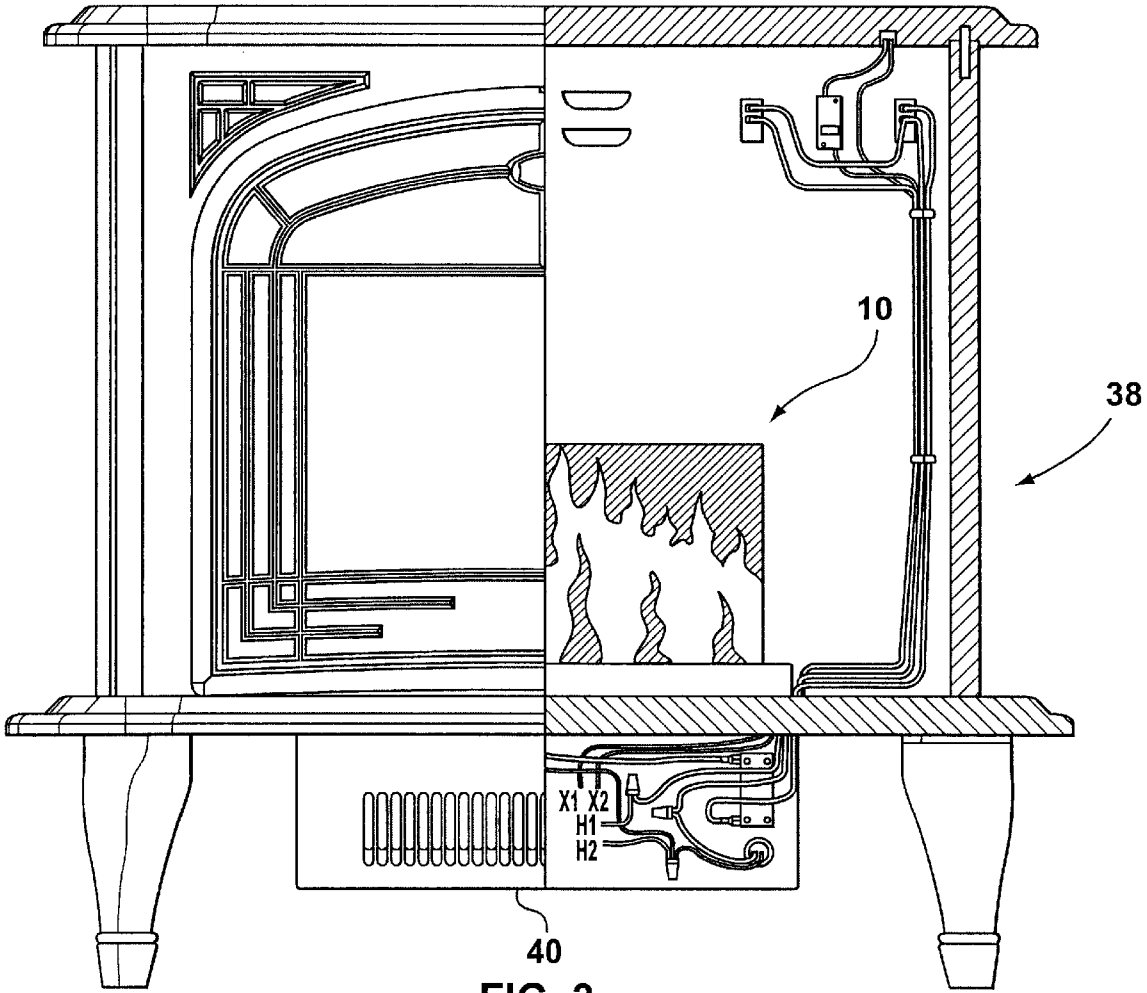
FIG. 3 is a partial sectional front view of the stove facsimile unit of FIG. 2, showing part of a vertical screen with a pattern resembling flames thereon.
Figure 4:
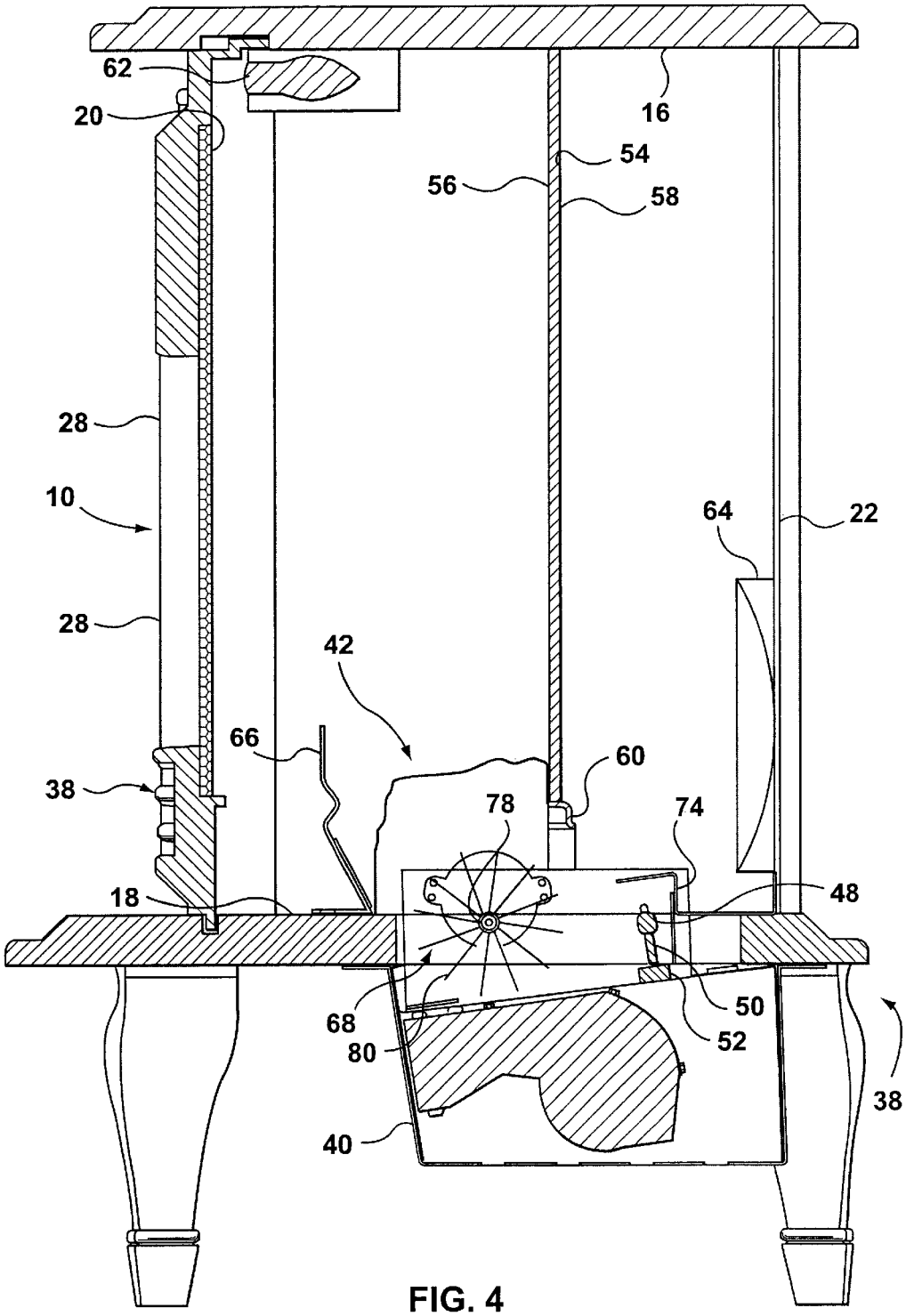
FIG. 4 is a side view of the stove facsimile unit of FIG. 2 showing elements behind a side wall.

A fire simulating assembly in accordance with the present invention is shown generally at 10 in FIGS. 1, 3, and 4. In FIG. 1, the assembly is shown incorporated within an electric fireplace which is depicted generally at 12 with an electrical connection 13 for connecting to a power source (not shown). It will be understood that the term "fireplace" used herein can relate to an insert fireplace fitted in a mantle or other aperture or to a free-standing stove.

The electric fireplace 12 includes a housing 14 that defines a simulated firebox having top, bottom, front, and rear walls 16, 18, 20, and 22, respectively, and side walls 24,26. A portion of the front wall is defined by a transparent front panel 28 that is removable to permit access to the contents of the housing 14. A fireplace control unit 30 includes a fireplace heater unit 32, a thermostat 34 for controlling the heat output and a main power switch 36 for actuating the fire effect.

Figure 2:
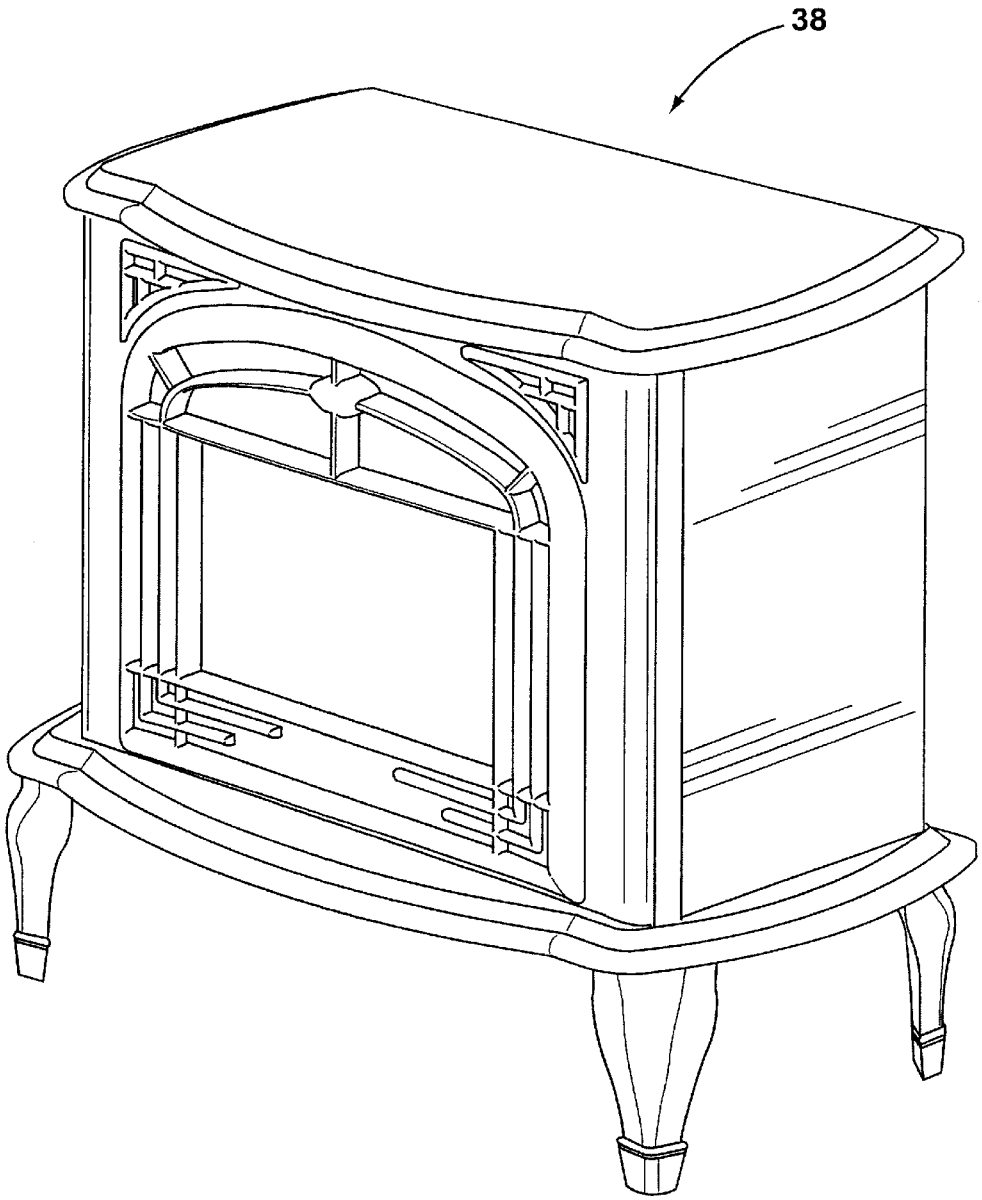
FIG. 2 is a perspective view of a stove facsimile unit into which the simulated firebox may be installed.

The fire simulating assembly 10 maybe incorporated into other structures, such as a stove facsimile unit indicated generally by the numeral 38 in FIG. 2. As can be seen in FIG. 2, the control unit is positioned on the stove facsimile unit 38 so that the control unit cannot be seen when the stove facsimile unit 38 is viewed generally from the front of the stove facsimile unit 38. The positioning of the fire simulating assembly 10 within the stove facsimile unit 38 can be seen in FIG. 3. Also, a stove heater unit 40 (also shown in a partial sectional view) is shown in FIG. 3 as being positioned underneath the bottom wall 18 in the stove facsimile unit 38. Except for the differences in locations of the stove control unit and the stove heater unit 40, the positioning of the fire simulating assembly 10 is generally the same in the electric fireplace and the stove facsimile unit.

The fire simulating assembly 10 maybe incorporated into other structures as well. Although the fire simulating assembly 10 is shown in FIG. 1 in an electric fireplace and in FIGS. 4 and 5 in a stove facsimile unit 38, such illustrations show examples only of structures incorporating the fire simulating assembly 10.

Figure 5:
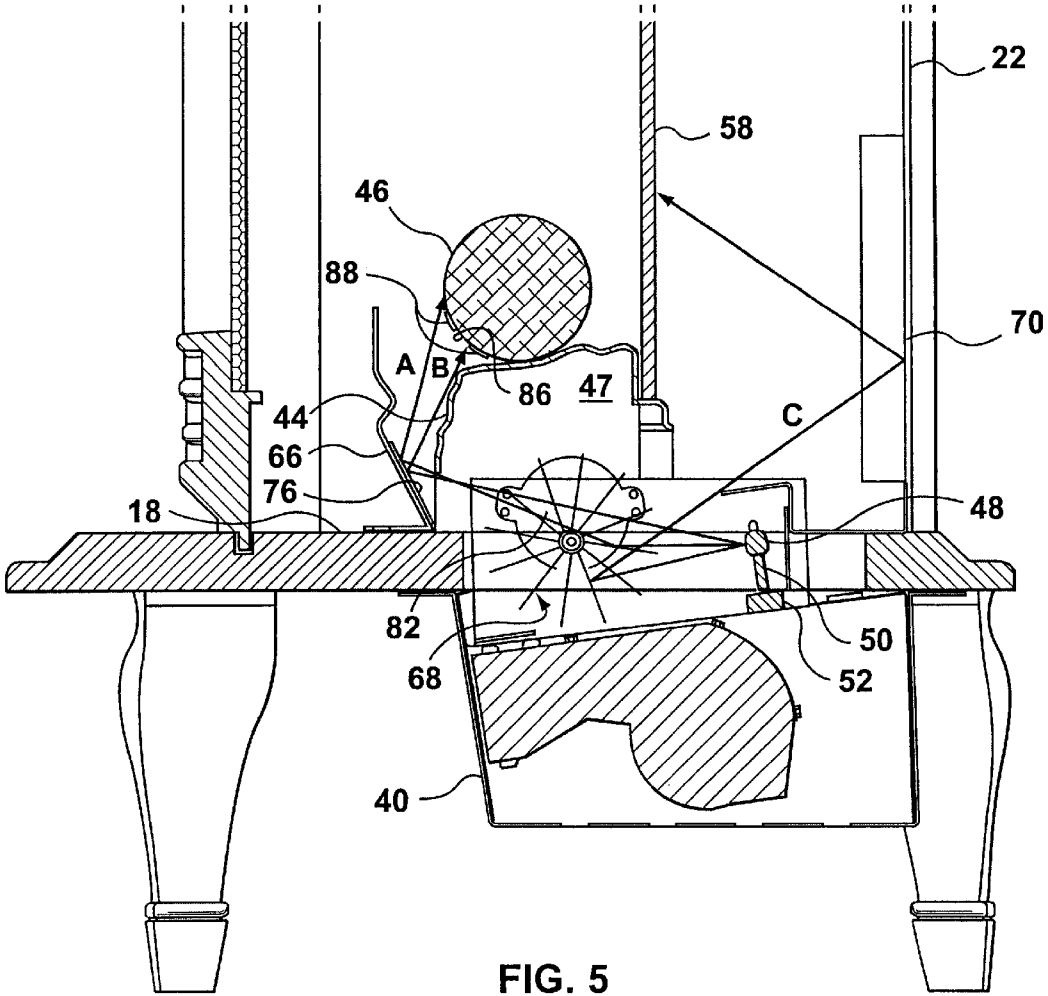
FIG. 5 is a side view of the stove facsimile unit of FIG. 2 drawn to a larger scale.
Figure 9:
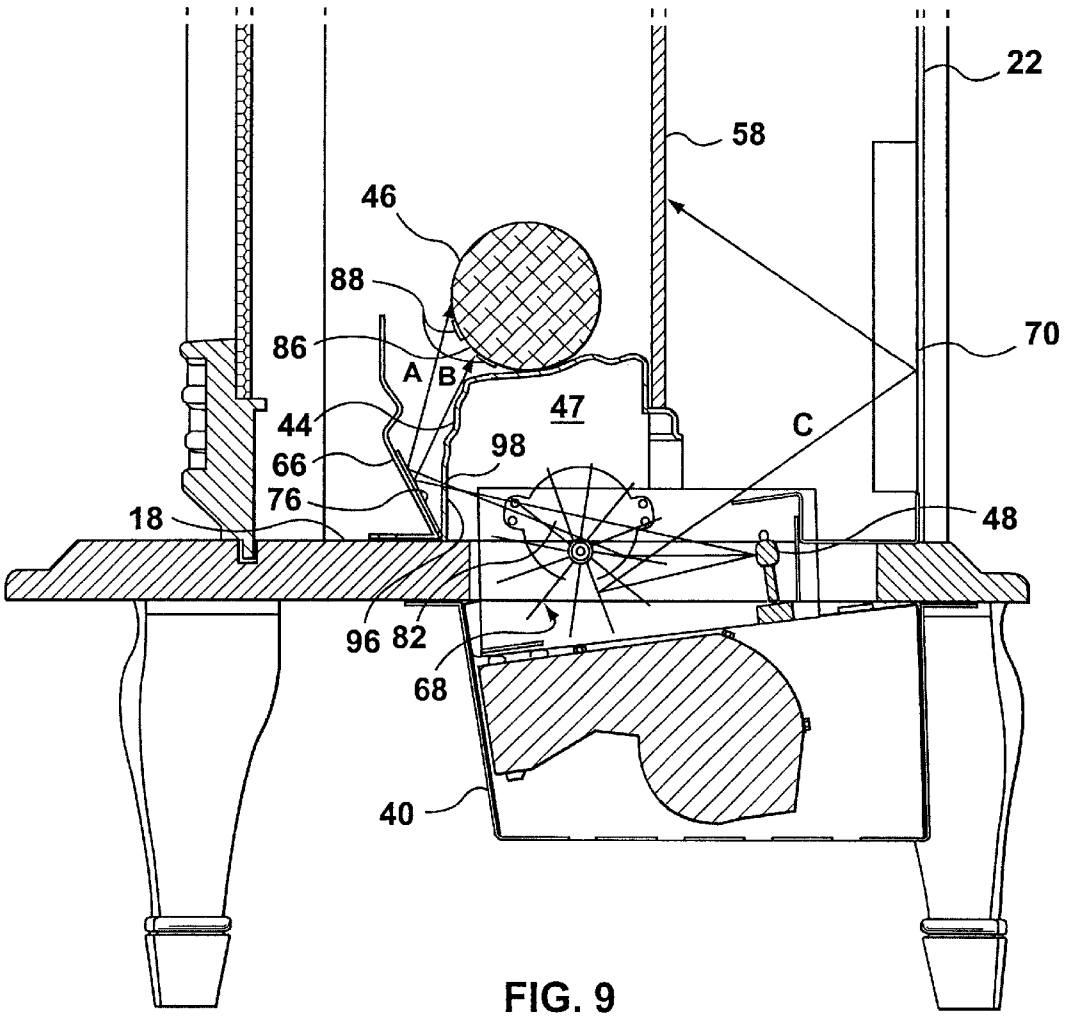
FIG. 9 is a side view of another preferred embodiment of the invention.

A simulated fuel bed assembly 42 (shown schematically in FIG. 4) is supported on the bottom wall 18 and located in a front portion of the housing 14. As can be seen in FIG. 5, the simulated fuel bed assembly 42 comprises a base 44 and a plurality of simulated log portions 46. Preferably, the base 44 is a plastic shell that is vacuum formed and colored to resemble logs and embers in a log burning fire. Also, it is preferred that the simulated log portions 46 comprise pieces of expanded polystyrene which have been shaped and colored to resemble burning logs and portions of burning logs. In addition to the materials described, different suitable materials may be used for making the base 44 or the simulated log portions 46. The base 44 is positioned above the bottom wall 18 and directly attached to the bottom wall 18. As can be seen in FIGS. 5 and 9, the base 44 and the bottom wall 18 at least partially define a compartment 47.

Preferably, portions of the base 44 are translucent to permit light from a light source 48 located beneath the fuel bed assembly 42 to shine through, as will be described. For example, the base 44 may be formed from an orange translucent plastic. The top side of the plastic shell may be painted, in whole or in part, to resemble the surfaces of logs. The underside of the plastic shell may be painted black (or some other opaque or non-translucent color) and then sanded in portions where it is desired for light to pass, so that the base 44 is partially translucent and partially opaque. For instance, the protruding points on the underside of the base 44 (corresponding to indents in the top side) may be sanded to allow light passage. These points would thus resemble the embers of a fire. Also, the crotch areas between simulated logs maybe sanded (or left unpainted) to resemble embers at the intersection of two logs.

Preferably, the light source 48 comprises at least one quartz halogen light which is supported in a socket 50 positioned below and rearward of the fuel bed assembly 42. Alternatively, one or more incandescent light bulbs or other sources of light may be utilized. The socket 50 is supported on a socket base 52 positioned on top of the stove heater unit 40. The intensity of the light can be varied with a dimmer switch 53 that is electrically connected to the light source 48 and located on the control unit 30.

Located immediately behind the simulated fuel bed assembly 42 is a vertical screen 54. As shown in FIGS. 4, 5, and 9, the vertical screen 54 is transparent and has a partially reflecting front surface 56 and a diffusing rear surface 58. The vertical screen 54 is on a screen support structure 60 fastened to the bottom wall 18. The vertical screen 54 is supported on its sides with side frame members (not shown) that are fastened to the side walls 24, 26 with fasteners (not shown). The vertical screen 54 is described in more detail in U.S. Pat. No. 4,965,707 which is incorporated herein by reference.

In another preferred embodiment (not shown), the partially reflecting forward surface 56 is disposed on a first vertical screen positioned forward of a second vertical screen on which the rear surface 58 is disposed, the diffusing surface 58 facing rearward. In this embodiment, the diffusing surface 58 can be shaped so that it is not planar.

The vertical screen 54 is positioned immediately behind the simulated fuel bed assembly 42 so that the simulated fuel bed assembly 42 will be reflected in the reflecting surface 56 to give the illusion of depth. As will be explained further below, the image of simulated flames appears to be emanating from between the simulated fuel bed assembly 42 and the reflection of the simulated fuel bed assembly 42 in the screen. Also, simulated flames appear to be emanating from the reflected image of the simulated fuel bed assembly 42. An upper light source 62 is located at the top front portion of the housing 14 for illuminating the top of the simulated fuel bed assembly 42 and enhancing the reflected image in the vertical screen 54.

Referring more closely to the fire simulating assembly 10, the assembly includes a rear mirror 64, a front reflector 66 and a flicker element 68.

Figure 6:
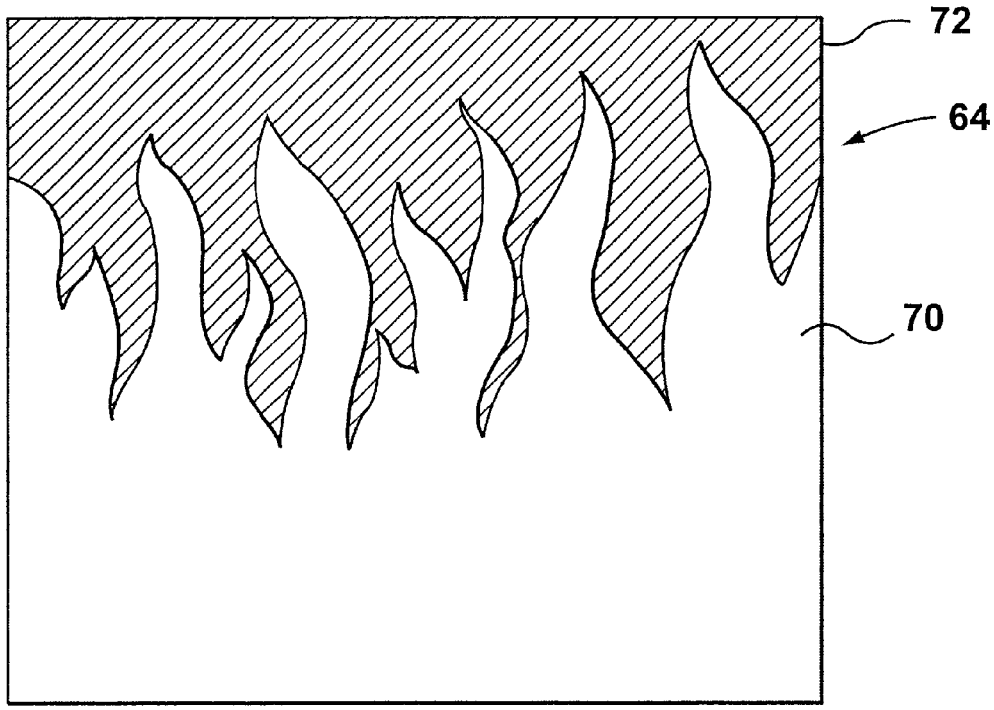
FIG. 6 is a front view of a rear mirror reflective surface of the preferred embodiment of FIG. 4.

As shown in FIG. 4, the rear mirror 64 has a concave shape. The rear mirror 64 can have a variety of shapes, but it is preferred that the rear mirror 64 has a concave shape. It can be seen in FIGS. 4 and 5 that rear mirror 64 is attached to the rear wall. The rear mirror 64 has a rear mirror reflective surface 70 which is directed toward the diffusing surface 58. The rear mirror reflective surface 70 can be disturbed by numerous ridges and valleys, but in a preferred embodiment, the rear mirror reflective surface is substantially smooth. As illustrated in FIG. 6, a rear mirror non-reflective surface 72 in a flame pattern is imposed on the rear mirror 64 adjacent to the rear mirror reflective surface 70. The rear mirror 64 extends across substantially the full width of the vertical screen 54. A light shield 74 prevents light from the light source 48 shining directly onto the rear mirror 64.

The front reflector 66 is rotatably mounted on the bottom wall 18 between the simulated fuel bed assembly 42 and the front wall 20. As can be seen in FIGS. 5 and 9, the front reflector 66 is positioned outside the compartment 47. The front reflector 66 is attached to the bottom wall 18 and positioned above the bottom wall 18 in a path of light from the light source 48 for reflecting light from the light source 48 onto the simulated log portions 46. The front reflector 66 has a front reflective surface 76, and the front reflector is oriented so that light can be reflected upwardly from the front reflective surface 76 toward the front of the simulated fuel bed assembly 42, as will be described.

Figure 7:
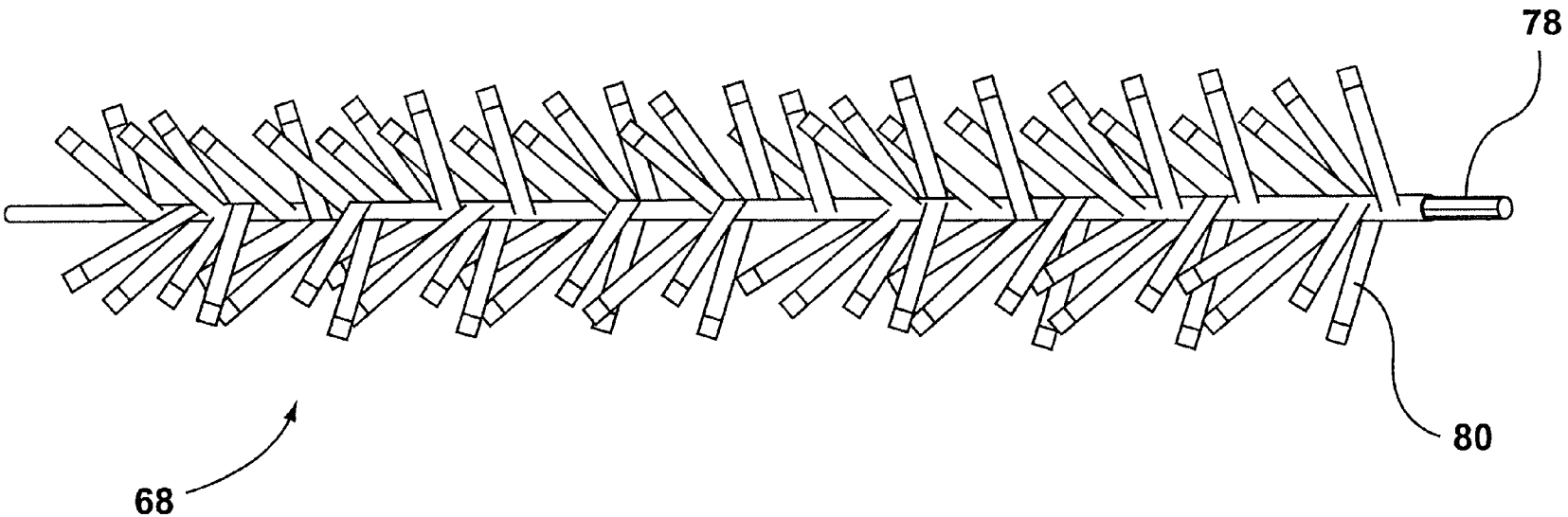
FIG. 7 is a perspective view of the flicker element of the preferred embodiment of FIG. 4.

As shown in FIGS. 4 and 5, the flicker element 68 is positioned between the light source 48 and the front reflector 66. The flicker element 68 is illustrated in FIG. 7. As can be seen in FIG. 7, the flicker element 68 comprises an elongate rod 78 having a plurality of reflective strips 80 extending radially outwardly therefrom. The reflective strips 80 are substantially silver in color. When the fire simulating assembly 10 is in operation, the flicker element 78 is rotated about the longitudinal axis of the elongate rod 78 by a rotator (not shown). The rotator can be any suitable means for rotating the flicker element 78 such as, for example, an electric motor (not shown). The direction of rotation of the flicker element 78 is such that the images of flames reflected onto the diffusing surface 58 appear to be rising upwardly from the simulated fuel bed assembly 42.

In use, light is transmitted from the light source 48 toward the rotating flicker element 68. As represented schematically by the rays labelled A and B in FIG. 5, light transmitted by the light source 48 passes through a region 82 through which the reflective strips 80 pass as the flicker element 68 is rotated to the front reflective surface 76. The reflective strips 80 are positioned so that light passing through the region 82 through which the reflective strips 80 pass is alternately and irregularly obscured, partially obscured, and permitted to pass to the reflective surface 76, and so that the intensity of light transmitted by the light source 48 to the front reflective surface 76 appears to vary irregularly. The apparent irregular variation in the intensity of the light transmitted by the light source 48 to the front reflective surface 76 results from the rotation of the flicker element 68, as light (represented schematically by ray A) is reflected by the reflective strips 80 and light (as represented schematically by ray B) is alternately obscured, partially obscured, and permitted to pass to the front reflective surface 76.

Light transmitted from the light source 48 simultaneously passes through the upper region 82, as represented schematically by rays labelled A and B in FIG. 5, and also is reflected by reflective strips 80 passing through a lower region 84 through which the reflective strips 80 also pass, as represented schematically by ray C in FIG. 5.

Light transmitted by the light source 48 and represented schematically by the ray labelled C in FIG. 5 is reflected by the reflective strips 80 onto the rear mirror reflective surface 70. Due to the rotation of the flicker element 68, the intensity of light transmitted by the light source 48 and reflected to the rear mirror reflective surface 70 by the reflective strips 80 also appears to vary irregularly.

The front reflector 66 is oriented so that light, as represented schematically by rays A and B in FIG. 5, is reflected upwardly by the front reflective surface 76 to illuminate the front of the base 44 and undersides 86 of the simulated log portions 46. In a preferred embodiment, the front reflective surface 76 is substantially red in color. As shown in FIGS. 5 and 9, reflective ember decals 88 can be positioned on the undersides 86 so that light reflected upwardly from the front reflective surface 76 will cause a simulated reddish glow to appear to emanate from the reflective ember decals 88. The reflective ember decals 88 can be substantially red in color or, alternatively, they can be substantially silver in color. The result is that the light reflected by the reflective ember decals 88 and undersides 86 resembles the light emanating from burning embers on the undersides of logs in a real fire. The effect is enhanced by the apparent irregular variation in the intensity of the light reflected onto the simulated fuel bed assembly 42 from the reflective surface 76, so that the simulated fuel bed assembly 42 simulates the appearance of real burning logs.

The rear mirror 64 is oriented so that light transmitted by the light source 48 and reflected from the reflective strips 80 onto the rear mirror reflective surface 70 is subsequently reflected onto the diffusing surface 58. Light reflected from the reflective strips 80 onto the rear mirror non-reflective surface 72 is not reflected onto the diffusing surface 58, so that a flame image is reflected onto the diffusing surface 58. The apparent irregular variations in the intensity of light reflected onto the rear mirror reflective surface 70 by the reflective strips 80 cause the flame image on the diffusing surface 58 to appear to vary irregularly in intensity in turn. The resulting effect is for the flame image reflected onto the diffusing surface 58 from the rear mirror 64 to resemble flames licking from a fire, the direction of rotation of the flicker element being such that the flame image appears to be moving upward.

The simulated fuel bed assembly 42 is positioned so that the simulated fuel bed 42 is reflected in the partially reflecting surface 56, and the flame image appears to be arising from the middle of the simulated fuel bed 42, as reflected.

The flame image appears to vary irregularly in intensity because of the irregular variation in light reflected by the reflective strips 80 onto the rear mirror reflective surface 70. The rate at which the flame image appears to vary in intensity irregularly is therefore relatively more rapid than the apparent variation in intensity of the light reflected onto the front of the simulated fuel bed assembly 42 by the front reflective surface 76. This difference in relative rates of apparent variation in intensity enhances the effect of the fire simulating assembly 10, as it mimics a difference in rates of variation in intensity of flames and burning embers in a real fire.

The reflective strips 80 can be made of MYLAR™ or any other suitable material.

Figure 8:
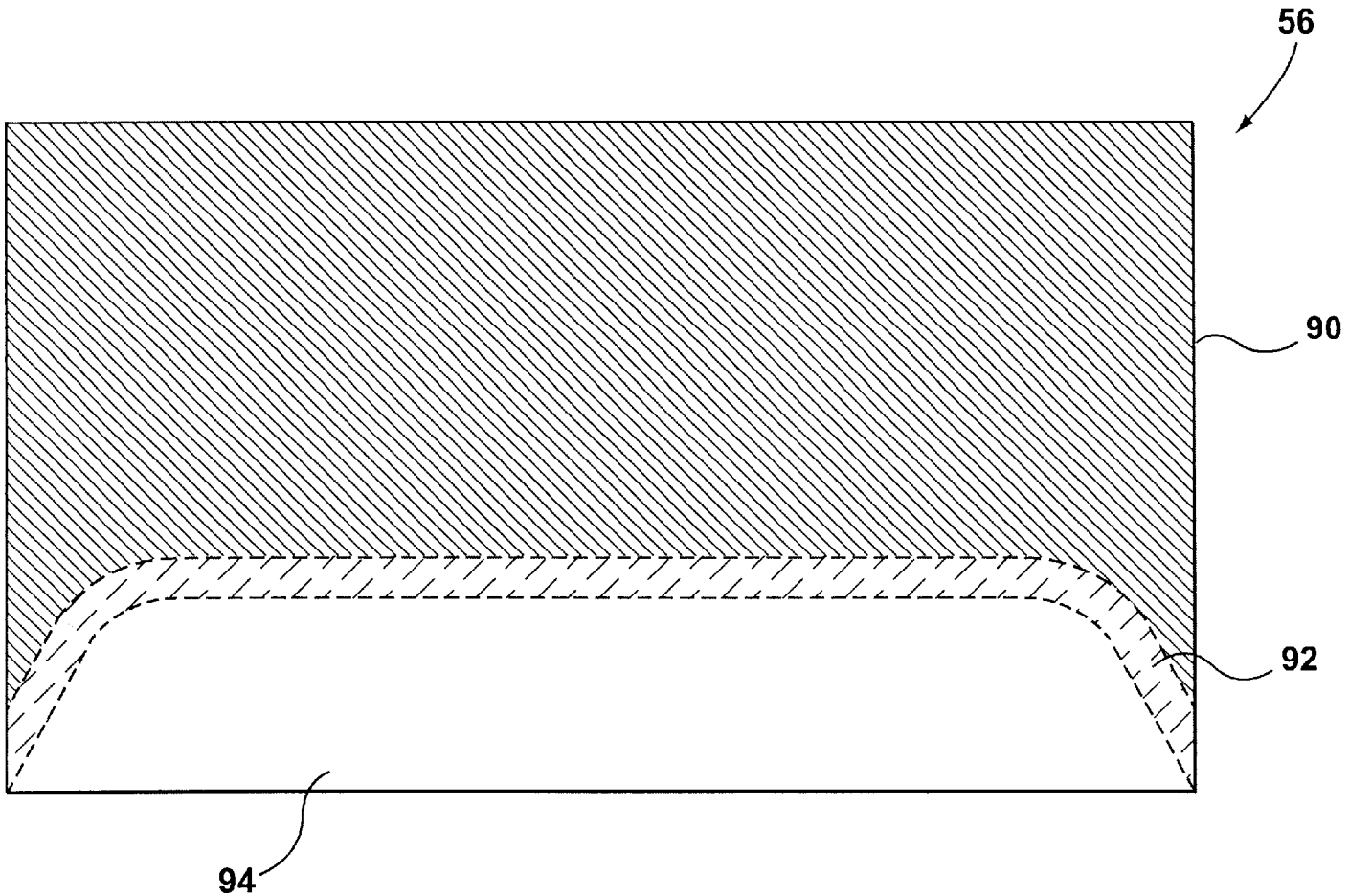
FIG. 8 is a front view of a vertical screen of the preferred embodiment of FIG. 4 showing a partially reflecting surface divided into regions.

Preferably, the partially reflecting surface 56 of the vertical screen 54 is divided into a non-reflective region 90, a transition region 92, and a reflecting region 94, as shown in FIG. 8. The reflecting region 94 is located at the lower end of the vertical screen 54 and is sufficiently sized for reflecting the simulated fuel bed assembly 42 to produce the simulated flame effect.

As can be seen in FIG. 9, in another preferred embodiment, a front translucent portion 98 of the base 44 extends downward to meet the bottom wall 18. Light transmitted by the light source 48 through the upper region 82 can pass through the front translucent portion 98 to the front reflective surface 76. Where the base 44 comprises a vacuum formed shell of translucent orange plastic, for example, and the front translucent portion 98 has substantially no paint on it, the front translucent portion 98 is colored substantially orange. In this preferred embodiment, light transmitted by the light source 48 and which has passed through the upper region 82 also passes through the front translucent portion 98 to provide a substantially orange light which appears to vary irregularly in intensity which passes to the front reflective surface 76. The front reflective surface 76 reflects the light upwardly onto the front of the simulated fuel bed assembly 42. In this preferred embodiment, the front reflective surface 76 is substantially silver in color.

It will be evident to those skilled in the art that the invention can take many forms and that such forms are within the scope of the invention as claimed.

I claim:

1. A fire simulating assembly for providing an appearance of burning embers in burning fuel having:

a simulated fuel bed for simulating burning fuel, the simulated fuel bed comprising a base and at least one simulated log portion disposed on the base;

a light source;

a flicker element for creating a fluctuating light;

a front reflector positioned in front of the simulated fuel bed and in a path of the fluctuating light between the flicker element and said at least one simulated log portion: and at least one front translucent portion included in the base and disposed in the path of the fluctuating light between the flicker element and the front reflector.

2. A fire simulating assembly for providing an appearance of burning embers in burning fuel having:

a simulated fuel bed for simulating burning fuel, the simulated fuel bed comprising a base and at least one simulated log portion disposed on the base;

a light source;

a screen having a front surface for diffusing and transmitting light, the screen being disposed behind the simulated fuel bed;

a flicker element for creating a fluctuating light;

a flame effect element positioned in a path of the fluctuating light between the light source and the screen, to configure the fluctuating light such that an image of flames appears through the front surface of the screen;

a front reflector positioned in front of the simulated fuel bed and in a path of the fluctuating light between the flicker element and said at least one simulated log portion;

at least one front translucent portion included in the base and disposed in the path of the fluctuating light between the flicker element and the front reflector; and at least one ember decal adapted to reflect light and positioned on said at least one simulated log portion such that the fluctuating light is reflected from the front reflector onto said at least one ember decal to provide an appearance of burning embers in burning fuel.

3. A fire simulating assembly for providing an appearance of burning embers in burning fuel having.

a simulated fuel bed for simulating burning fuel, the simulated fuel bed comprising a base and at least one simulated log portion dispose on the base;

a light source;

a screen having a partially reflective front surface disposed behind the simulated fuel bed for reflecting and transmitting light, and a diffusing rear surface disposed behind the partially reflective front surface for diffusing and transmitting light;

a flicker element for creating a fluctuating light;

a flame effect element positioned in a path of the fluctuating light between the light source and the screen, to configure the fluctuating light such that an image of flames appears through the front surface of the screen;

a front reflector positioned in front of the simulated fuel bed and in a path of the fluctuating light between the flicker element and said at least one simulated log portion;

at least one front translucent portion included in the base and disposed in the path of the fluctuating light between the flicker element and the front reflector; and at least one ember decal adapted to reflect light and positioned on said at least one simulated log portion such that the fluctuating light is reflected from the front reflector onto said at least one ember decal to provide an appearance of burning embers in burning fuel.

4. A fire simulating assembly for providing an appearance of burning embers in burning fuel having:

a simulated fuel bed for simulating burning fuel, the simulated fuel bed comprising a base and at least one simulated log portion disposed on the base;

a light source;

a front reflector positioned in front of the simulated fuel bed and in a path of light from the light source; and at least one front translucent portion included in the base and disposed in the path of light from the light source between the light source and the front reflector, for transmitting light from the light source to the front reflector.

5. A fire simulating assembly for providing a simulation of burning embers in burning fuel having:

a simulated fuel bed for simulating burning fuel, the simulated fuel bed including a base and at least one simulated log portion disposed on the base;

a bottom wall, the base being positioned above the bottom wall and directly attached to the bottom wall;

the base and the bottom wall at least partially defining a compartment;

a front wall positioned in front of the simulated fuel bed, the front wall including a transparent front panel;

a light source; and a front reflector attached to the bottom wall and positioned outside the compartment and between the base and the front wall, the front reflector being positioned above the bottom wall and in a path of light from the light source for reflecting light from the light source onto said at least one simulated log portion.

6. A fire simulating assembly according to claim 5 in which the front reflector includes a reflective surface for reflecting light from the light source onto said at least one simulated log portion, and in which the reflective surface is substantially red in color.

7. A fire simulating assembly according to claim 5 in which said at least one simulated log portion includes a plurality of ember decals positioned in a path of light from the light source reflected from the front reflector onto said at least one simulated log portion.

8. A fire simulating assembly according to claim 5 in which the base of the simulated fuel bed includes a substantially horizontal portion supporting said at least one simulated log portion and a partition portion depending from the horizontal portion between the front reflector and the light source, the partition portion including at least one opening for permitting light to be transmitted from the light source to the front reflector.

9. A fire simulating assembly according to claim 5 additionally including a flicker element for creating a fluctuating light, and in which the front reflector is positioned between the simulated fuel bed and the front wall and in a path of the fluctuating light for reflecting the fluctuating light onto said at least one simulated log portion.

* * * * *

UNITED STATES PATENT AND TRADEMARK OFFICE

CERTIFICATE OF CORRECTION

PATENT NO. : 6,564,485 B1
DATED : May 20, 2003
INVENTOR(S) : Kristoffer Hess

It is certified that error appears in the above-identified patent and that said Letters Patent is hereby corrected as shown below:

Columns 7, 8 and 9, after Column 7, line 45,
Claims 1 to 4 are replaced by the following:

--1. A fire simulating assembly for providing an appearance of burning embers in burning fuel having:

a simulated fuel bed for simulating burning fuel, the simulated fuel bed comprising a base and at least one simulated log portion disposed on the base;
a light source;
a flicker element for creating a fluctuating light;
a front reflector positioned in front of the simulated fuel bed and in a path of the fluctuating light between the flicker element and said at least one simulated log portion; and
at least one front translucent portion included in the base and disposed in the path of the fluctuating light between the flicker element and the front reflector.

2. A fire simulating assembly for providing an appearance of burning embers in burning fuel having:

a simulated fuel bed for simulating burning fuel, the simulated fuel bed comprising a base and at least one simulated log portion disposed on the base;
a light source;
a screen having a front surface for diffusing and transmitting light, the screen being disposed behind the simulated fuel bed;
a flicker element for creating a fluctuating light;
a flame effect element positioned in a path of the fluctuating light between the light source and the screen, to configure the fluctuating light such that an image of flames appears through the front surface of the screen;
a front reflector positioned in front of the simulated fuel bed and in a path of the fluctuating light between the flicker element and said at least one simulated log portion;
at least one front translucent portion included in the base and disposed in the path of the fluctuating light between the flicker element and the front reflector; and
at least one ember decal adapted to reflect light and positioned on said at least one simulated log portion such that the fluctuating light is reflected from the front reflector onto said at least one ember decal to provide an appearance of burning embers in burning fuel.

UNITED STATES PATENT AND TRADEMARK OFFICE

CERTIFICATE OF CORRECTION

PATENT NO. : 6,564,485 B1
DATED : May 20, 2003
INVENTOR(S) : Kristoffer Hess

It is certified that error appears in the above-identified patent and that said Letters Patent is hereby corrected as shown below:

Columns 7, 8 and 9, after Column 7, line 45 cont'd,

3. A fire simulating assembly for providing an appearance of burning embers in burning fuel having:

a simulated fuel bed for simulating burning fuel, the simulated fuel bed comprising a base and at least one simulated log portion disposed on the base;
a light source;
a screen having a partially reflective front surface disposed behind the simulated fuel bed for reflecting and transmitting light, and a diffusing rear surface disposed behind the partially reflective front surface for diffusing and transmitting light;
a flicker element for creating a fluctuating light;
a flame effect element positioned in a path of the fluctuating light between the light source and the screen, to configure the fluctuating light such that an image of flames appears through the front surface of the screen;
a front reflector positioned in front of the simulated fuel bed and in a path of the fluctuating light between the flicker element and said at least one simulated log portion;
at least one front translucent portion included in the base and disposed in the path of the fluctuating light between the flicker element and the front reflector; and
at least one ember decal adapted to reflect light and positioned on said at least one simulated log portion such that the fluctuating light is reflected from the front reflector onto said at least one ember decal to provide an appearance of burning embers in burning fuel.

4. A fire simulating assembly for providing an appearance of burning embers in burning fuel having:

a simulated fuel bed for simulating burning fuel, the simulated fuel bed comprising a base and at least one simulated log portion disposed on the base;
a light source;
a front reflector positioned in front of the simulated fuel bed and in a path of light from the light source; and
at least one front translucent portion included in the base and disposed in the path of light from the light source between the light source and the front reflector, for transmitting light from the light source to the front reflector.--

Signed and Sealed this

Second Day of March, 2004

JON W. DUDAS
*Acting Director of the United States Patent and Trademark Office*